United States Patent [19]

Maidon

[11] 4,077,064

[45] Mar. 7, 1978

[54] JUMPING SUIT FOR A PARACHUTIST

[75] Inventor: René Louis Maidon, Clichy, France

[73] Assignee: Etudes et Fabrications Aeronautiques, France

[21] Appl. No.: 750,694

[22] Filed: Dec. 15, 1976

Related U.S. Application Data

[63] Continuation of Ser. No. 572,090, Apr. 28, 1975, abandoned.

[30] Foreign Application Priority Data

Apr. 30, 1974 France ..... 74 15089

[51] Int. Cl.[2] ..... A62B 17/00

[52] U.S. Cl. ..... 2/2.1 R

[58] Field of Search ..... 2/2, 2.1 R, 2.1 A, 75, 2/93, 94, 27

[56] References Cited

U.S. PATENT DOCUMENTS

| | | | |
|---|---|---|---|
| 2,410,632 | 11/1946 | Colley et al. | 2/2.1 R |
| 2,886,027 | 5/1959 | Henry | 2/2.1 A |
| 3,449,761 | 6/1969 | Long | 2/2.1 R |
| 3,533,107 | 10/1970 | Raneri et al. | 2/93 |
| 3,945,042 | 3/1976 | Lobo | 2/2 |

FOREIGN PATENT DOCUMENTS

| | | | |
|---|---|---|---|
| 1,332,132 | 6/1963 | France | 2/94 |
| 989,943 | 4/1965 | United Kingdom | 2/75 |

*Primary Examiner*—Alfred R. Guest

[57] ABSTRACT

The jumping suit is for a parachutist taking part in competition or sport with a group of parachutists. Suit holding and retaining means are provided on the suit on the outer side of the arms and legs of the parachutist in the form of beading which is fixed to the suit fabric and forms an outer rib capable of being taken hold of by the hand of an adjacent parachutist.

12 Claims, 3 Drawing Figures

JUMPING SUIT FOR A PARACHUTIST

This is a continuation of application Ser. No. 572,090, filed Apr. 28, 1975, abandoned.

The present invention relates to jumping suits or combinations employed by parachutists and more particularly by competition or sports parachutists effecting relative working groups.

It is known that in relative work carried out in a group the parachutists form different figures, such as stars or other figures, while falling freely by holding on to each other by their hands or by different parts of their suits.

One of the main difficulties encountered by the parachutists is the difficulty of seizing by hand, usually with gloves on, a part of the suit of the parachutist effecting evolutions next to him.

Indeed, when falling freely, the relative wind tends to flatten the suit or combination against the body of the parachutist.

If the latter carries an improved suit or combination, such as that disclosed in French Patent application No. 7345483, filed on Dec. 19, 1973 by the Applicant, which is adapted to be inflated by the relative wind, the cloth or fabric thus made taut is also very difficult to seize owing to the fact that there is nothing to get a grip on.

It has been envisaged to secure handles to parts of the suits by means of which the parachutists preferably hold on to each other.

However, this solution has been abandoned owing to the fact that firstly it is difficult in free fall to seize a precise part of the combination of the parachutist in the course of the evolutions and, secondly, there is a great and permanent risk of these handles becoming accidentally and dangerously hooked onto something.

An object of the invention is to provide an improved jumping suit or combination having extensive easily-seized regions whereby the suit can be easily taken hold of and held with no risk of the suit escaping while there is no liability of these regions becoming accidentally hooked onto some object.

According to the invention, there is provided an improved jumping suit for a parachutist for use in competition or sport for effecting relative work in a group of parachutists while falling freely, comprising suit holding and retaining means capable of being seized by the hand of another parachutist, said means comprising elongated elements and means fixing the elongated elements to a surface of the suit, the elongated elements extending on a part of the length of the sleeves and trousers of the suit to be adjacent the outside of the arms and legs of the parachutist.

It will be understood that by means of this arrangement the fabric of the suit has "ribs" constituted by said elements which are fastened to the fabric and are easily taken hold of and retained when they are gripped in the hand with the adjacent fabric.

It will also be understood that as the fabric of the suit is loosely surrounding the body of the parachutist, there will be no difficulty in gripping these elements. Even in the aforementioned case of an inflated suit, the fabric is spaced away from the body of the parachutist and will react like a cushion on each side of the element and will not prevent a proper grip to be had on the elements.

Further features and advantages of the invention will be apparent from the ensuing description with reference to the accompanying drawing given by way of example and in which.

Figure 1:
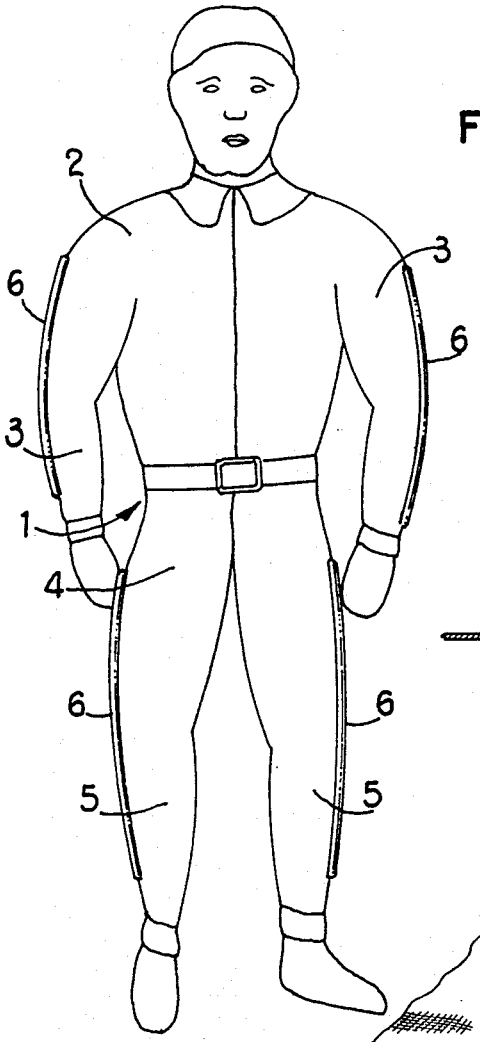
FIG. 1 is a diagrammatic assembly view of a jumping suit or combination according to the invention for a parachutist.

FIG. 1 shows a jumping suit or combination 1 for a parachutist which comprises in the conventional manner a jacket 2 having sleeves 3 and trousers 4 having leg portions 5. The jacket part and trousers part may be interconnected or separate.

In the illustrated embodiment, the suit or combination comprises flexible elongated elements 6 connected or fixed to the suit fabric on parts of the latter by which the parachutists carrying out relative work take hold of and retain each other namely: along the arms and along the legs on the outer parts of these limbs.

These elements 6 of a flexible material such as natural or synthetic rubber, plastics material or some other elastomer have a cylindrical shape and any section, may be solid or tubular and are connected to the fabric throughout their length.

Figure 3:
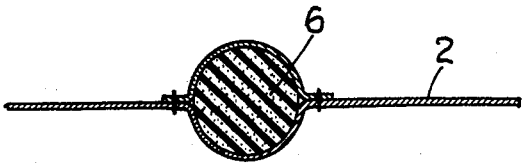
FIG. 3 is a sectional view taken on line 3—3 of FIG. 2.
Figure 2:
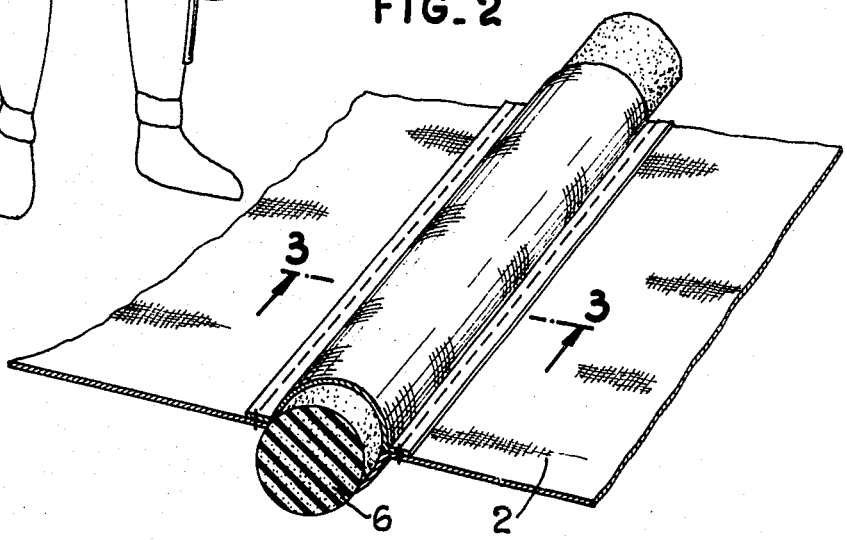
FIG. 2 is a perspective view of a piece of the fabric of the suit shown in FIG. 1.

According to a preferred embodiment of the invention, the elements are constituted by a beading of neoprene 6 which is applied to the inner surface of the fabric 7 and is held in position by a strip of fabric 8 which is so disposed as to completely cover the length of the element 6 and is sewn to the fabric of the suit on each side of the beading in slightly compressing the latter as shown at 9 in FIGS. 2 and 3.

The elements 6 are arranged in such manner as to extend on the major part of the length of the arm and the major part of the length of the leg, for example respectively from the shoulder to a point located a little above the wrist and from the upper end of the thighs to a point a little above the ankle.

The elements 6 may also be constituted by lengths of a tube or a simple pipe of rubber, plastics material or any polymer, or a beading of fibres, a cable or other means.

They may also be fixed by direct adhesion to the fabric but preferably inside the suit so as to avoid that the elements become torn from the suit.

The fact of disposing the elements 6 on the inner surface of the fabric permits the use of a manner of fixing which may be weaker than the fixing produced by the fabric strip 8. Indeed, when the part of the suit to which an element 6 is applied is seized fully by the hand, the force exerted traps this element in a fold formed by the fabric which practically completely surrounds it.

It could therefore suffice to fix the elements 6 at points or regions spaced apart along its length, these fixing point being, however, sufficiently close together so that it is impossible to seize the fabric of the suit without seizing the element 6 at the same time.

Consequently, the fixing points must not be spaced apart a distance greater than about one half of the average width of a hand, namely about 5 cm.

These fixing points may also be produced by adhesion, direct stitching of the element to the fabric or by other means. However, they must be sufficiently strong to withstand the pulling forces exerted thereon by the parachutists in the course of their evolutions.

Note that when the elements 6 are secured to the outer surface of the suit fabric in a continuous manner throughout their length or when they are secured to the inner surface of the fabric, the suit holding and retaining means or rib thus formed is in coextensive and adjoining relation to the outer surface of the suit fabric through the length of the rib so that there is no danger of the rib hooking onto some object.

It will be understood that the elements 6 may be provided, if need be, in other parts of the suit other than those shown and described.

I claim:

1. In a sky-diving suit of the type to be worn loosely by the parachutist in an aircraft and therefore devoid of pressurizing means for high altitudes having a flexible wall defining sleeves and trousers for a parachutist for use in competition or sport for effecting relative work in a group of parachutists while falling freely from an aircraft; the improvement comprising in combination means for facilitating the taking hold of and the gripping of the wall of the suit when sky-diving by the hand of another parachutist in the course of diving, said gripping means consisting of elongated elements and means combining each of the elongated elements with and fixing the elongated element to the wall of the suit so as to constitute an elongated seizable projecting structure which is coextensive with and adjoins the outside of the wall of the suit in a continuous manner throughout the length of the element so that gaps and cavities in and projections on the structure liable to accidentally hook onto objects are avoided, the elongated elements being discrete and independent of each other and extending on a part of the length of the sleeves and trousers of the suit solely on the outside of the arms and legs of the parachutist, the parts of the wall defining the sleeves and trousers being of the type which loosely surround the legs and arms of the parachutist in use at least in the aircraft before sky-diving.

2. A suit as claimed in claim 1, wherein the elongated elements are fixed to an inner surface of the wall of the suit.

3. A suit as claimed in claim 2, wherein the wall of the suit is made from fabric and the fabric forms folds substantially parallel to the elements, said elongated elements being fixed in the folds and the folds substantially completely surrounding the corresponding elongate element.

4. A suit as claimed in claim 2, wherein said elongated element is fixed to the wall of the suit in regions spaced along the length of the elongated element.

5. A suit as claimed in claim 4, wherein the spacing between the fixing regions is less than about 5 centimeters.

6. A suit as claimed in claim 1, wherein the elongated elements are fixed to an outer surface of the wall of the suit.

7. A suit as claimed in claim 6, wherein the wall of the suit is made from fabric and a strip of fabric fixed each elongated element to the fabric wall, the strip covering and partly surrounding the elongated element and being secured to the fabric wall on each side of the elongated element so that the elongated element is trapped between the fabric wall and the strip throughout the length of the elongated element.

8. A suit as claimed in claim 7, wherein the strip is sewn to the fabric wall.

9. A suit as claimed in claim 7, wherein the strip is adhered to the fabric wall.

10. A suit as claimed in claim 7, wherein the strip is clipped to the fabric wall.

11. A suit as claimed in claim 1, wherein said elongated elements are each in the form of a beading.

12. In a sky-diving suit of the type to be worn loosely by the parachutist in an aircraft and therefore devoid of pressurizing means for high altitudes having a flexible wall defining sleeves and trousers for a parachutist for use in competition or sport for effecting relative work in a group of parachutists while falling freely from an aircraft; the improvement comprising in combination means for facilitating the taking hold of and the gripping of the wall of the suit when sky-diving by the hand of another parachutist in the course of diving, said gripping means consisting of elongated elements and flexible means fixing the elongated elements to a surface of the wall of the suit so as to completely enclose the elongated elements between said wall and said flexible means in a continuous manner throughout the length of the elongated elements, the elongated elements being discree and independent of each other and extending on a part of the length of the sleeves and trousers of the suit solely on the outside of the arms and legs of the parachutist, the parts of the wall defining the sleeves and trousers being of the type which loosely surround the legs and arms of the parachutist in use at least in the aircraft before sky-diving.

* * * * *